US007214150B2

(12) United States Patent
Filice et al.

(10) Patent No.: US 7,214,150 B2
(45) Date of Patent: May 8, 2007

(54) LACROSSE STICK HEAD WITH BALL GUIDANCE AND CONTROL FINGERS

(75) Inventors: Gary Filice, Moorpark, CA (US); Dean E. Meyer, Oakbrook, IL (US); Scot Brown Herbst, Douglas, MI (US)

(73) Assignee: Easton Sports, Inc., Van Nuys, CA (US)

( * ) Notice: Subject to any disclaimer, the term of this patent is extended or adjusted under 35 U.S.C. 154(b) by 0 days.

(21) Appl. No.: 10/664,728

(22) Filed: Sep. 19, 2003

(65) Prior Publication Data

US 2005/0064963 A1 Mar. 24, 2005

(51) Int. Cl.
*A63B 59/02* (2006.01)
*A63B 65/12* (2006.01)

(52) U.S. Cl. ..... 473/513; D21/724

(58) Field of Classification Search ..... 473/513, 473/512, 528, 514, 543; D21/724
See application file for complete search history.

(56) References Cited

U.S. PATENT DOCUMENTS

| | | | | |
|---|---|---|---|---|
| 2,710,753 | A * | 6/1955 | Lockwood | 473/513 |
| 3,473,806 | A | 10/1969 | Patterson | |
| 3,507,495 | A | 4/1970 | Tucker et al. | |
| 3,822,062 | A | 7/1974 | Tucker et al. | |
| D236,737 | S | 9/1975 | Brine et al. | |
| 3,905,088 | A | 9/1975 | Tucker et al. | |
| 4,037,841 | A | 7/1977 | Lewis, Jr. | |
| 4,138,111 | A | 2/1979 | Rule | |
| 4,206,918 | A | 6/1980 | Lewis, Jr. | |
| 4,270,756 | A | 6/1981 | Ahlenfeld et al. | |
| 4,358,117 | A | 11/1982 | Deutsch | |
| RE31,419 | E | 10/1983 | Frolow | |
| 4,657,260 | A | 4/1987 | Brine, Jr. | |
| 4,739,994 | A | 4/1988 | Lewis, Jr. | |
| D297,963 | S | 10/1988 | Tucker et al. | |
| 4,940,243 | A | 7/1990 | Tucker et al. | |

(Continued)

OTHER PUBLICATIONS

Webpage downloaded Aug. 19, 2005, deBeer Wizard Head, www.dealhaven.com, www.rock-itpocket.com, Mar. 18, 2002, 10 pages.*

(Continued)

*Primary Examiner*—Eugene Kim
*Assistant Examiner*—M. Chambers
(74) *Attorney, Agent, or Firm*—Olson & Hierl, Ltd.

(57) ABSTRACT

A head of a lacrosse stick including a frame defining a back stop wall at one end, a scoop wall at an opposite end and side walls therebetween. A plurality of fingers are spaced along the interior face of the back wall and side walls respectively. Each of the fingers protrude outwardly from the interior face of the back wall and side walls respectively and include an outer sloped surface adapted to guide and direct a lacrosse ball into the pocket of the head. Each of the fingers also include a lower sloped shoulder adapted to hold the lacrosse ball in the head and guide and direct the ball between the back wall and the scoop wall. In one embodiment, the length of the fingers increases between the back wall and the side walls to define a pocket for the ball and then decreases along the side walls in the direction of the scoop wall to define a ball ramp.

30 Claims, 10 Drawing Sheets

U.S. PATENT DOCUMENTS

| | | | | |
|---|---|---|---|---|
| 5,007,652 | A | | 4/1991 | Tucker et al. |
| D318,509 | S | * | 7/1991 | Naumburg, Jr. ..... D21/724 |
| 5,035,434 | A | | 7/1991 | Taylor et al. |
| 5,037,112 | A | | 8/1991 | Brine, III et al. |
| 5,048,843 | A | | 9/1991 | Dorfi et al. |
| 5,054,790 | A | | 10/1991 | Brine |
| 5,067,726 | A | | 11/1991 | Brine, III et al. |
| 5,080,372 | A | | 1/1992 | Brine, III et al. |
| 5,082,290 | A | | 1/1992 | Tucker et al. |
| 5,269,532 | A | | 12/1993 | Tucker et al. |
| 5,494,297 | A | | 2/1996 | MacNeil |
| 5,566,947 | A | | 10/1996 | Tucker et al. |
| 5,651,549 | A | | 7/1997 | Dill et al. |
| 5,674,140 | A | | 10/1997 | Tucker et al. |
| 5,685,791 | A | | 11/1997 | Feeney |
| 5,935,026 | A | | 8/1999 | Dill et al. |
| 6,066,056 | A | * | 5/2000 | Morrow ..... 473/513 |
| 6,506,132 | B1 | | 1/2003 | Brine, III et al. |
| 6,561,932 | B2 | | 5/2003 | Morrow et al. |
| 6,723,134 | B2 | * | 4/2004 | Tucker, Sr. ..... 473/513 |
| 6,852,047 | B2 | | 2/2005 | Tucker |
| 2002/0160865 | A1 | | 10/2002 | Brine, III et al. |
| 2002/0173388 | A1 | | 11/2002 | Morrow et al. |
| 2002/0198070 | A1 | | 12/2002 | Tucker et al. |

OTHER PUBLICATIONS

Selected pages from 2003 STX Equipment and Apparel Catalog.
Photographs of Warrior Lacrosse Head acquired in 2003 (shown in Figures 1, 5 and 6 of U.S. Patent No. 6,561,932).
Photographs of Debeer "Wizard" Head acquired in Feb. 2004 (date of first sale unknown).
Photographs of Brine "Prophecy/Control-X" Head acquired in Jan. 2004 (date of first sale unknown).
Photographs of Brine "Edge" Head acquired in 2003 (shown in Figure 1 of U.S. Patent No. 5,651,549).

* cited by examiner

LACROSSE STICK HEAD WITH BALL GUIDANCE AND CONTROL FINGERS

FIELD OF THE INVENTION

This invention relates generally to the head of a lacrosse stick and, more particularly, to fingers therein adapted to guide and control the movement of a lacrosse ball in and out of the head.

BACKGROUND OF THE INVENTION

As is well known, the sport of lacrosse involves the use of sticks including heads adapted to serve three basic functions, i.e., to receive or scoop a lacrosse ball, to hold and control a lacrosse ball, and to pass or shoot a lacrosse ball.

Several different types of heads have been developed over the years with features intended to assist a player with one or more of the above-identified functions. While some of these previously developed heads have been satisfactory, there remains a need for a lacrosse stick head adapted to maximize the ball receiving, guiding and control functions thereof. This invention meets these needs.

SUMMARY OF THE INVENTION

The invention relates to a head of a lacrosse stick comprising a frame including upper and lower edges and an interior face therebetween and a plurality of elongate ball guide fingers spaced along the interior face of the frame and extending between the upper and lower edges in a directional relationship generally opposite thereto. Each of the fingers protrude and project outwardly from the interior face of the frame and include an outer surface which slopes outwardly between the upper and lower edges. Each of the fingers terminate in a shoulder extending and protruding outwardly from the interior face of the frame.

The frame includes a back wall at one end, a scoop wall at the other end and a pair of side walls therebetween. In one embodiment, the length of the fingers increases progressively between the back wall and respective side walls to define an arc corresponding in shape to the arc or radius of a lacrosse ball and then decreases progressively along each of the respective side walls in the direction of the scoop wall to define a guide ramp for the lacrosse ball.

The shoulder on each of the fingers is also preferably sloped and the slope of the shoulders of successive fingers decreases progressively between the back wall and the respective side walls and then increases progressively along the respective side walls in the direction of the scoop wall.

In one embodiment, the fingers protrude unitarily outwardly from the interior face of the frame. In another embodiment, a separate insert made of a material different than the material comprising the frame is adapted to be adhesively secured to the interior face of the frame and the fingers protrude unitarily outwardly from the exterior face of the insert.

In still another embodiment, a separate sleeved insert made of a material different than the material comprising the frame is adapted to cover the top edge of the frame and the interior and exterior faces thereof and the fingers protrude unitarily outwardly from an exterior face of the insert.

In still a further embodiment, an overlay made of a second material is molded directly to the interior of the frame and the fingers protrude unitarily outwardly from an exterior face of the overlay.

The shoulder on each of the fingers is also preferably sloped and the slope of the shoulders of successive fingers decreases progressively between the back wall and the respective side walls and then increases progressively along the respective side walls in the direction of the scoop wall.

BRIEF DESCRIPTION OF THE DRAWINGS

In the accompanying drawings forming part of the specification in which like numerals are employed to designate like parts throughout the same.

DETAILED DESCRIPTION OF THE PREFERRED EMBODIMENTS

Figure 1:
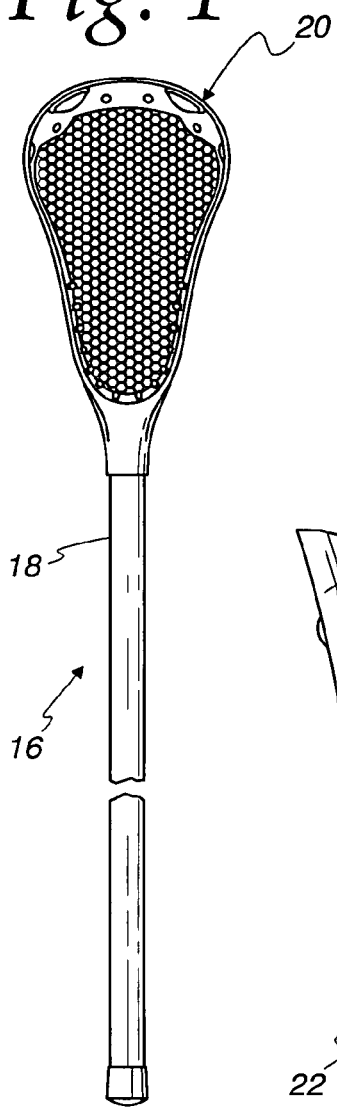
FIG. 1 is a front elevational view of a lacrosse stick incorporating a head incorporating the features of the present invention.

The invention disclosed herein is, of course, susceptible of embodiment in many different forms. Shown in the drawings and described herein below in detail are preferred embodiments of the lacrosse stick head of the present invention. It is to be understood, however, that the present disclosure is an exemplification of the principles of the invention and does not limit the invention to the illustrated embodiments.

It is also understood that the FIGS. herein do not necessarily show details of the lacrosse stick head that are known in the art and that will be recognized by those skilled in the art as such. The detailed descriptions of such elements are not necessary to an understanding of the invention. Accordingly, such elements are herein represented only to the degree necessary to aid in an understanding of the features of the present invention.

FIG. 1 depicts a lacrosse stick 16 comprising an elongate handle 18 and a lacrosse stick head 20 incorporating the features of the present invention.

Referring to FIGS. 2–5, head 20 comprises a frame 22 which is typically made of an injection-molded, monolithic, durable and rigid material such as, for example, nylon, urethane or polycarbonate. Frame 22 includes a base 24 defining an interior opening 26 in one end thereof which is adapted to receive the proximal end of the handle 18.

Figure 2:
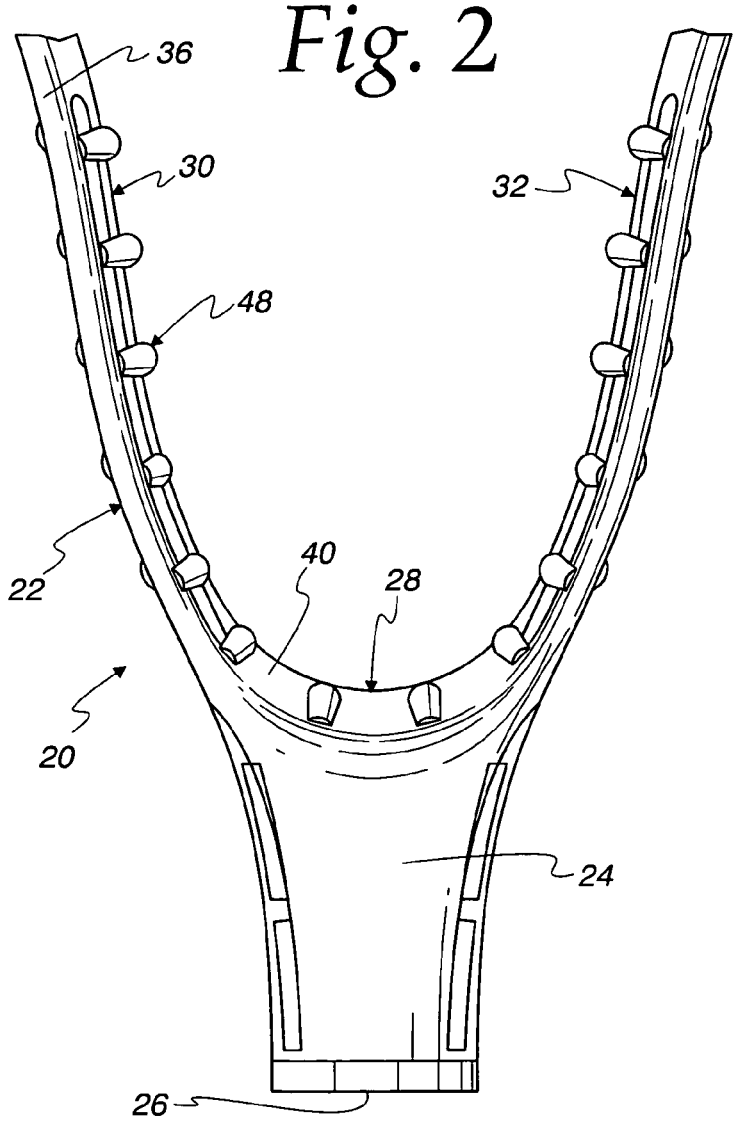
FIG. 2 is a broken, front elevational view of the lacrosse stick head of the present invention excluding the netting.
Figure 3:
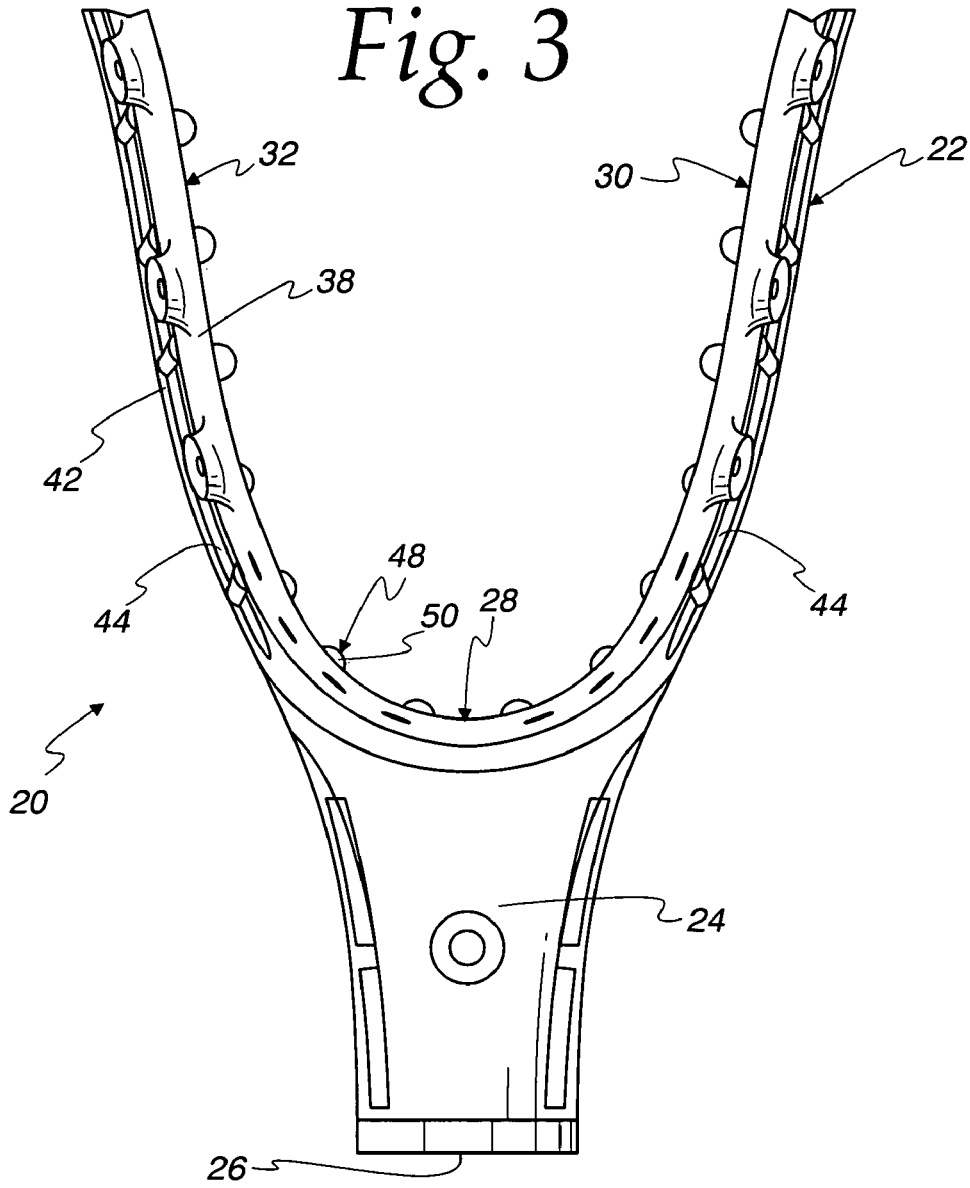
FIG. 3 is a broken, rear elevational view of the lacrosse stick head of FIG. 1 excluding the netting.

The other end of the base 24 defines an arcuate ball back stop wall 28. Frame 22 additionally defines a pair of sidewalls 30 and 32 extending unitarily outwardly and forwardly from opposite ends of the back stop wall 28. As shown in FIG. 2, the back wall 28 and side walls 30 and 32 cooperate together to form a "U". An arcuate scoop wall 34 (FIG. 5), located opposite the back wall 28, extends unitarily between and joins the ends of the side walls 30 and 32. The back stop wall 28, side walls 30 and 32 and scoop wall 34 together define a frame 22 including an interior generally vertical face 40 and an exterior generally vertical face 42 (as viewed from the perspective of FIGS. 2–5).

Elongate openings 44 and 46 are defined in and extend between and through the interior and exterior faces 40 and 42 of each of the side walls 30 and 32 respectively.

In accordance with the first embodiment of the present invention, a plurality of individual molded elongate rail or bar-like fingers 48 protrude and project unitarily outwardly from the interior face 40 of the frame 22 and, more particularly, from the interior face 40 of the back stop wall 28 and side walls 30 and 32 thereof. In the up and down or vertical direction (when viewed from the perspective of FIGS. 2–5), each of the fingers 48 extend between, and in a generally vertical orientation, direction and relationship generally transverse or opposite to, the top (upper) and bottom (lower) edges 36 and 38 of the frame 22. Each of the fingers 48 extend longitudinally continuously from a point on the interior face 40 generally adjacent the top edge 36 in the direction of the bottom edge 38 and include an exterior arcuate or rounded face or surface 49 (FIG. 4) which slopes outwardly and downwardly away from the interior face 40 from a point adjacent the top edge 36 in the direction of the bottom edge 38 to define a lower shoulder 50 which protrudes and projects unitarily generally normally outwardly from the interior face 40 of the walls 28, 30 and 32 respectively. Stated another way, the distance which each of the fingers 48 protrude outwardly from the interior face 40 increases as the fingers 48 extend longitudinally between the top and bottom edges 36 and 38 of the frame 22. The slope on the exterior surface 49 of each of the fingers 48 varies between about five degrees for the fingers 48 located in the region of the back wall 28 and progressively increases, in the direction of the scoop wall 34, between about five degrees and twenty degrees for the fingers 48 extending along the respective side walls 30 and 32.

Figure 4:
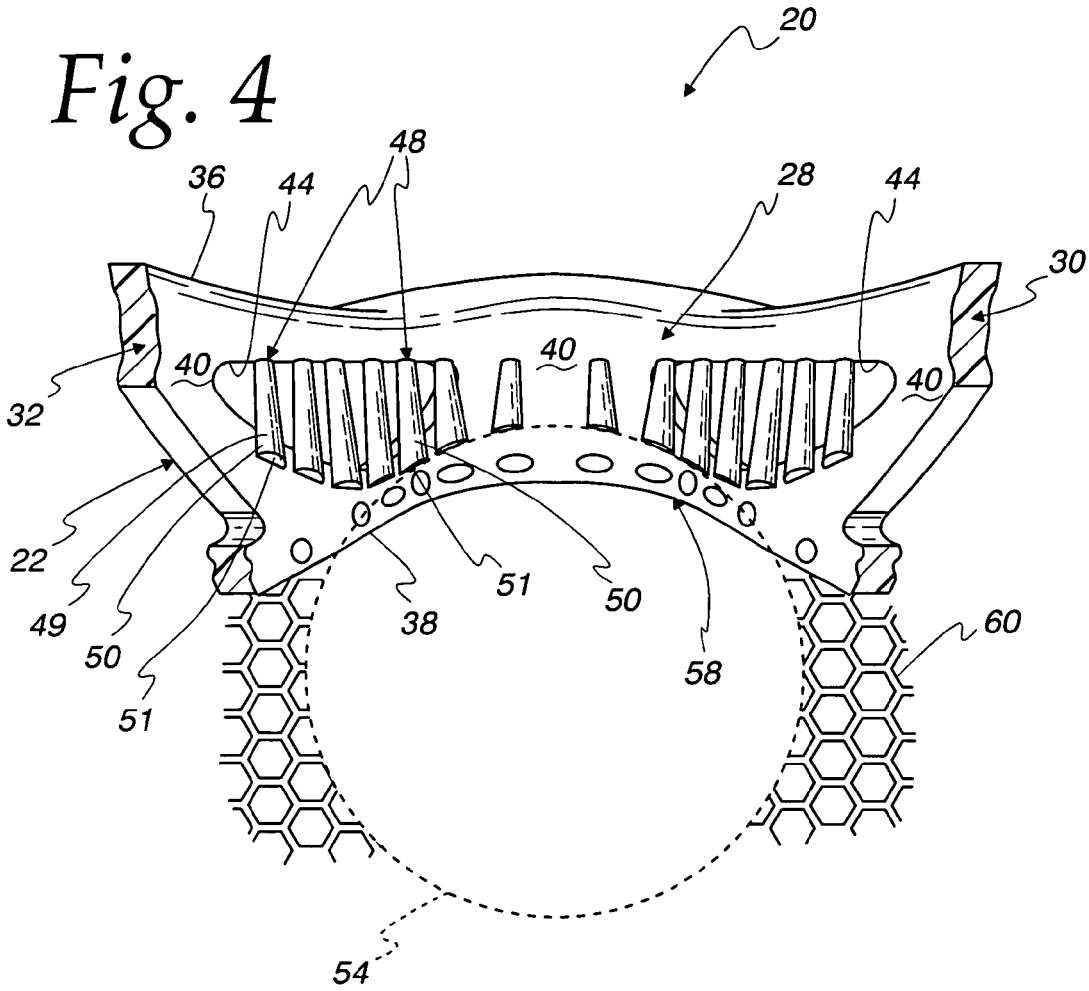
FIG. 4 is a broken, end elevational view of the lacrosse stick head of FIG. 1 depicting the manner in which a lacrosse ball is held in the pocket of the head.
Figure 5:
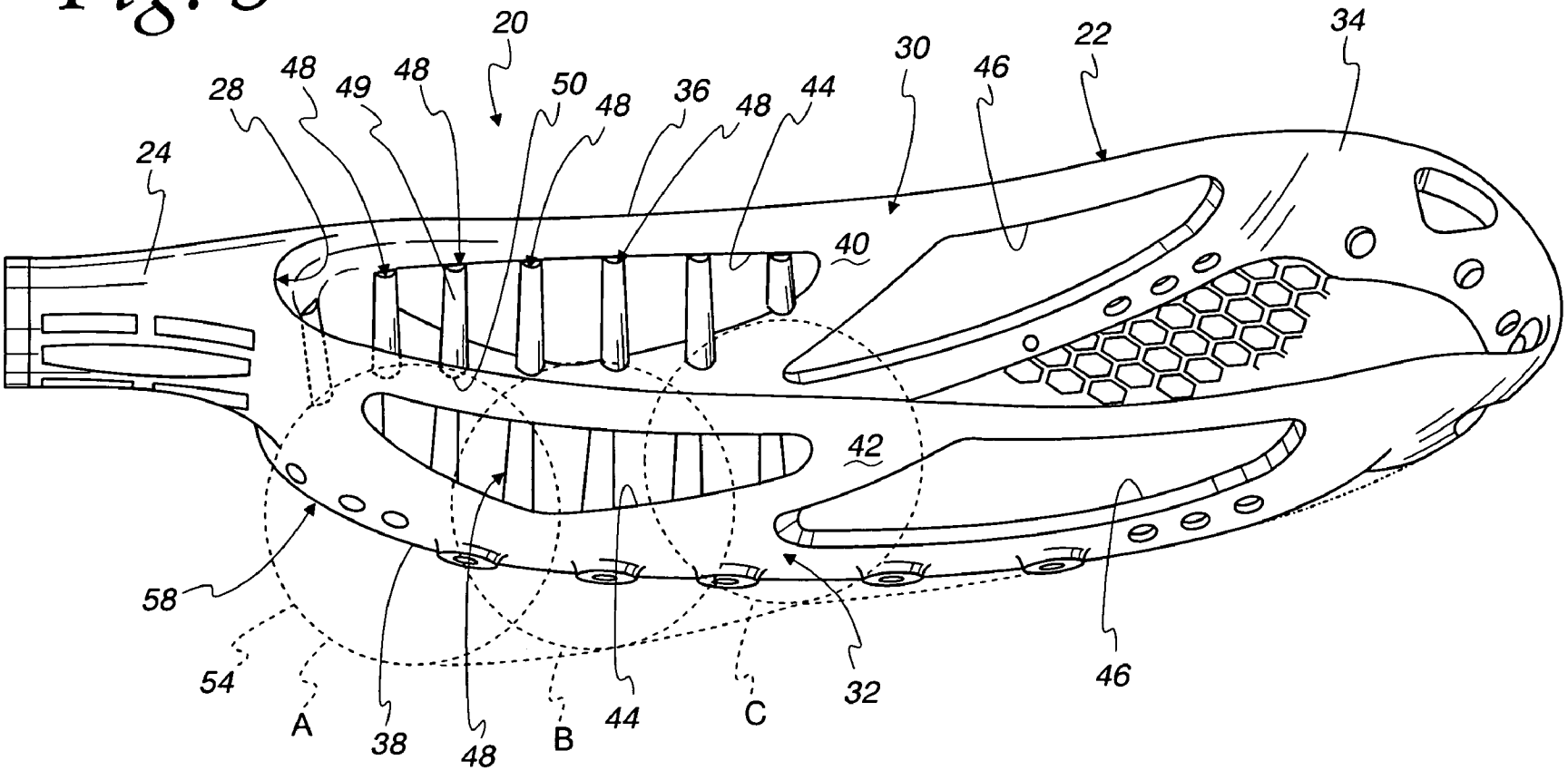
FIG. 5 is a side perspective view of the lacrosse stick head of FIG. 1 depicting the manner in which the fingers hold and guide the lacrosse ball between the pocket and the scoop of the head.
Figure 6:
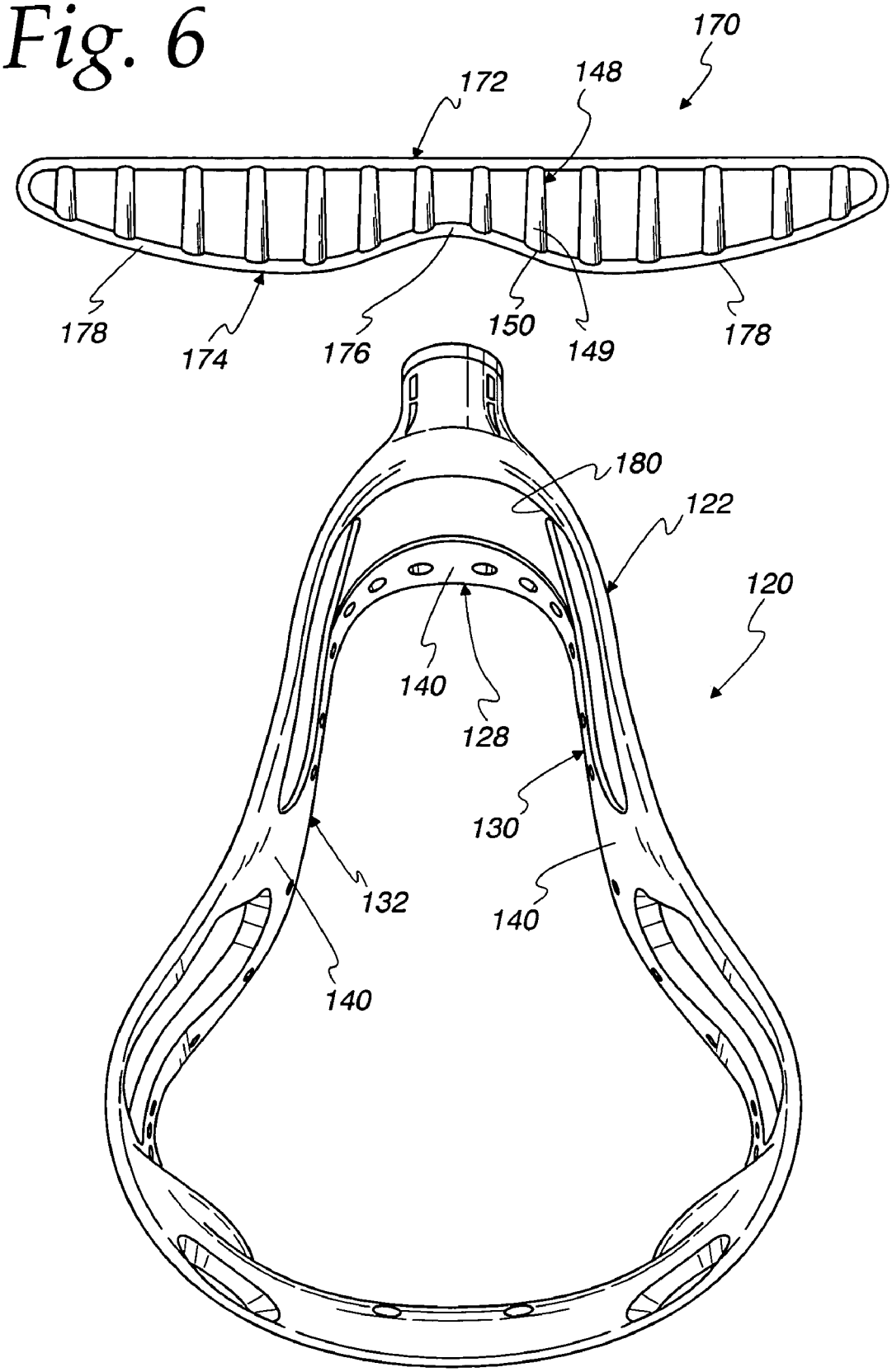
FIG. 6 is a top, exploded perspective view of a second embodiment of the lacrosse stick head wherein the fingers are unitary with a separate insert.
Figure 7:
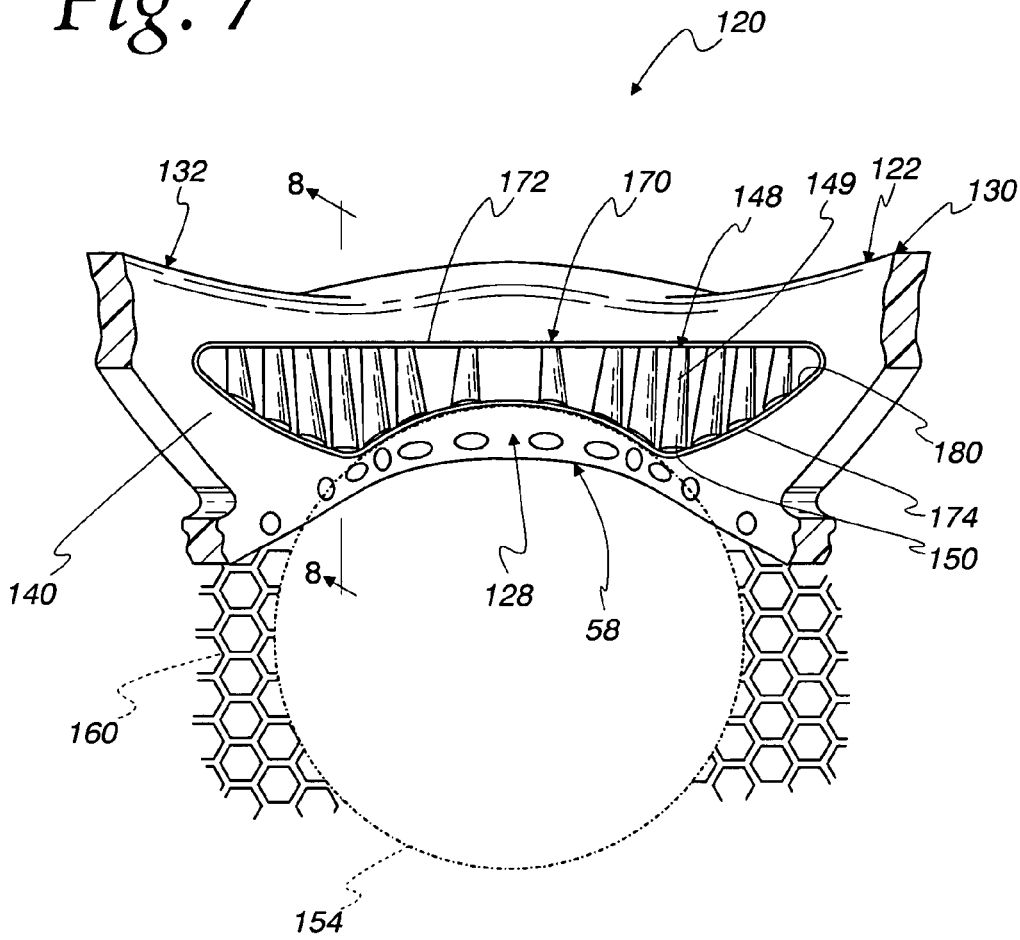
FIG. 7 is a broken, end elevational view of the lacrosse stick head of FIG. 6 with the insert adhesively secured to the interior face of the back stop wall and side walls of the head.

In the horizontal direction, as also viewed from the perspective of FIGS. 2–5, fingers 48 extend along and about the interior face 40 of the back wall 28 and side walls 30 and 32 in a generally spaced-apart and parallel relationship. The fingers 48 terminate on the side walls 30 and 32 at a point immediately fore of the distal end of the openings 44 defined therein. Moreover, and as shown in FIGS. 4 and 5, the fingers 48 vary in length, the length thereof being dependent upon and determined by the location or placement thereof along either the back wall 28 or the side walls 30 and 32. Still further, the fingers 48 located in the region of the respective side walls 30 and 32 extend through the openings 44 defined therein.

Particularly, the fingers 48 located in the region of the back wall 28 are sized such that the respective successive lower shoulders 50 thereof together define an arc or curve corresponding generally in shape to the peripheral outer curve or radius of the lacrosse ball 54. The fingers 48 located on each of the side walls 30 and 32 respectively gradually decrease in length between the end of the back wall 28 and the respective openings 46 therein to define a curved guide ramp which extends outwardly and upwardly along the interior surface of the side walls 30 and 32 in the direction of the scoop wall 34. The fingers 48 on side wall 30 are mirror images of the fingers 48 on side wall 32. Stated another way, the fingers 48 vary in length along the interior face 40 of the back wall 28 and respective side walls 30 and 32 in a relationship wherein the fingers 48 initially generally progressively increase in length between the center and opposite ends of the back wall 28 and then generally progressively decrease in length along each of the side walls 30 and 32 respectively between the respective ends of the back wall 28 and the ends of the respective side walls 30 and 32.

Still further, and as shown in FIGS. 4 and 5, the slope or angular orientation of each of the shoulders 50 of the respective fingers 48, relative to the interior generally vertical frame face 40, varies between the back wall 28 and the side walls 30 and 32 from a range of between about zero to a minus fifteen degrees in the region between the center and ends of the back wall 28 to a range of between about zero to a positive fifteen degrees in the region between the end of the back wall 28 and the ends of the respective side walls 30 and 32. Stated another way, the slope of the shoulders 50 of successive fingers 48 generally progressively decreases between the center and end of the back wall 28 as the fingers 48 increase in length while the slope of the shoulders 50 of successive fingers 48 in the region of the respective side walls 30 and 32 generally progressively increases between the end of the back wall 28 and the end of the respective side walls 30 and 32 as the length of the fingers 48 decreases and as the slope of the walls 49 of the fingers 48 increases between about five and twenty degrees.

Figure 8:
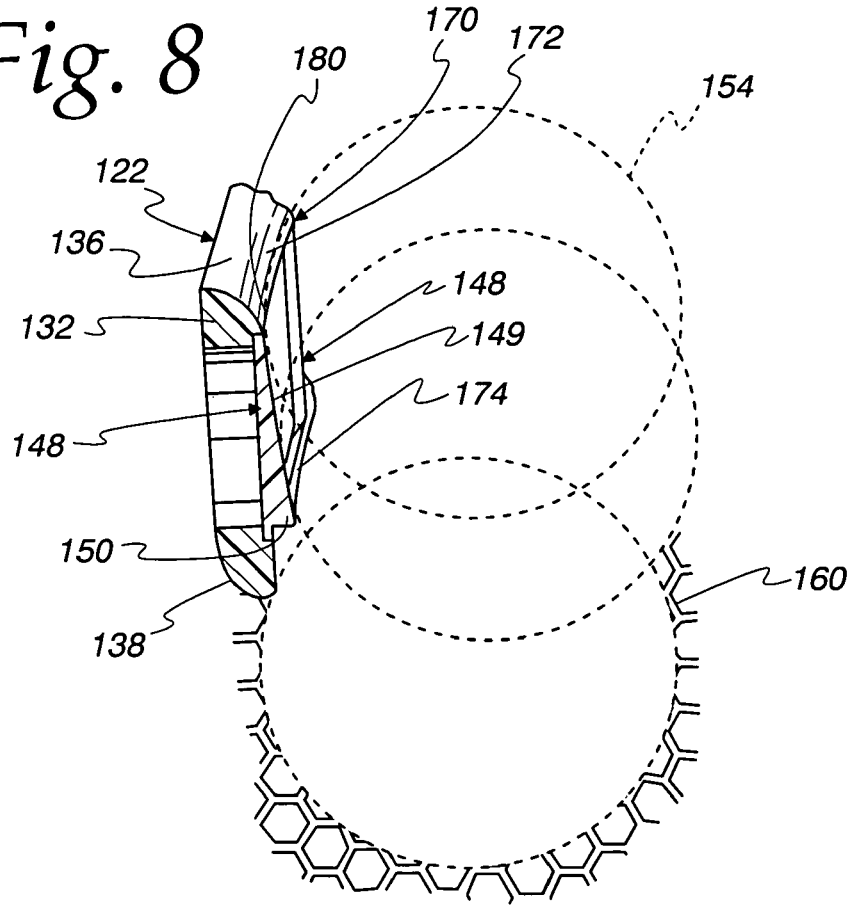
FIG. 8 is an enlarged, broken vertical cross-sectional view of one of the fingers taken along the lines 8—8 in FIG. 7 and depicting the movement of a lacrosse ball into the head.
Figure 9:
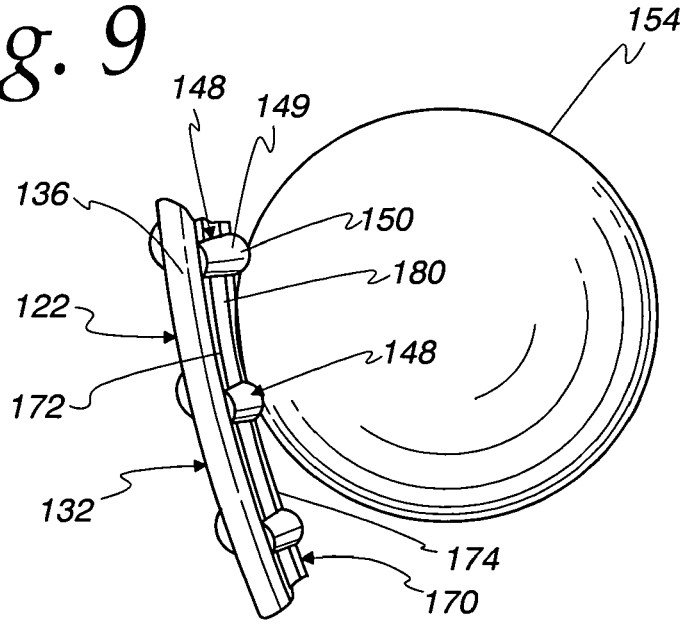
FIG. 9 is an enlarged, broken top perspective view depicting the manner in which the fingers are adapted to cradle a lacrosse ball.

In accordance with the present invention, the fingers 48 serve several different ball guidance, holding and control functions as shown in FIG. 4 and 5 which depict the head 20 with fingers 48 and FIGS. 8 and 9 which depict an alternate head embodiment 120 incorporating fingers 148 which are similar in structure to fingers 48.

Initially, and as shown in FIGS. 8 and 9, the outward slope on the outer surface 149 of each of the fingers 148 advantageously allows a lacrosse ball 154, entering the head 120 in the region of the upper edge 136 of either of the side walls (the side wall 132 is shown in FIGS. 8 and 9), to roll downwardly and inwardly along and in contact with the outer surface 149 of the fingers 148 towards the lower edge 138 and then into the center of the ball pocket 158 defined in part by the netting 160.

Additionally, and as shown in FIGS. 4 and 5, the positioning and length of the respective fingers 48 between the respective upper and lower edges 36 and 38 is such that the respective shoulders 50 thereof are spaced a distance from the lower edge 38 which allows the ball 54 to be held in the pocket 58 in a relationship wherein the top peripheral surface of the ball 54 is positioned in abutting relationship against the sloped interior surface 51 of the shoulders 50 of the respective fingers 48 located in the region of the back wall 28. In this relationship, the side peripheral surface of the ball 54 is positioned in abutting relationship with the interior face 40 of back wall 28 and the bottom peripheral surface of the ball 54 is positioned in abutting relationship with the bottom of the net 60 thereby effectively and advantageously holding the ball 54 between the netting 60 and shoulders 50 of the fingers 48. This feature is particularly advantageous in those game situations where an opposing player's strategy is to dislodge the ball from the head. The fingers, of course, will make dislodgement more difficult.

The fingers 48 not only are adapted to guide, hold and control the ball 54 in the pocket 58 as described above but also further are adapted to guide and hold the ball 54 in the frame 22 during the travel of the ball 54 between the scoop 34 and the pocket 58 (when the ball 54 is received through the scoop 34) and the ball's travel between the pocket 58 and the scoop 34 when the ball is either passed to another player or shot on goal.

As shown in FIG. 5, the positioning and length of the respective successive fingers 48 which span the respective side walls 30 and 32 is such that the respective shoulders 50 thereof are spaced from the lower edge 38 in the vertical direction a distance which allows the shoulders 50 of the ball 54 to define ball guide and stop bumpers against which the top peripheral surface of the ball 54 bumps against as the ball 54 rolls outwardly and upwardly between the pocket 58 and the scoop 34. More specifically, the respective fingers 48 are selectively positioned on the side walls 30 and 32 in a manner which allows the ball 54 to roll between the pocket 58 and the scoop 34 in a relationship wherein the top peripheral surface is in abutting relationship with the shoulders 50 of the respective fingers 48 and the lower peripheral surface of the ball 54 is in abutting relationship with the bottom of the net 60 as the ball travels along the side walls in the direction of the scoop 34. The shoulders 50 thus serve the dual purpose of guiding the ball 54 between the pocket 58 and the scoop 34 and preventing the ball 54 from falling outwardly of the head 20 as the ball 54 rolls between the pocket 58 and the scoop 34 and vice versa.

Moreover, and as shown in both FIGS. 5 and 9, the spacing between successive fingers 48,148 allows the ball 54, 154 to be cradled between any two successive fingers 48, 148 in the course of its travel between the pocket and the scoop. As a result, the fingers 48, 148 provide the additional advantage of allowing a player to effectively hold and control the ball 54, 154 in the head 20, 120 at several different longitudinal points between the pocket 58 and the scoop depending upon the play intended to be executed. For example, in a game situation where a player's intent is simply to hold and carry the ball 54, fingers 48 allow the ball 54 to be cradled in the left most "A" pocket position shown in FIG. 5. However, in the situation where a player's intent is to ready the ball 54 to be either passed or shot on goal, fingers 48 advantageously allow a player to transfer and hold the ball 54 in either the "B" or "C" cradling ball positions depicted in FIG. 5 prior to advancing the ball 54 into the area of the scoop 34. The ability to effectively hold the ball 54 at several different locations along the length of the side walls advantageously reduces the distance between the ball 54 and the scoop 34 which, in turn, advantageously reduces the time required to execute a pass or attempt a shot on goal.

FIGS. 6–9 depict the head embodiment 120 constructed in accordance with the present invention. Head 120 is similar in structure to the head 20 except that the plurality of individual ball guidance and control fingers 148 thereof have been formed on and protrude unitarily outwardly from the surface of a separate preformed and pre-molded insert 170.

In accordance with the head embodiment 120, the frame 122 is preferably made of the same type of durable and rigid synthetic material as the head 20 while the insert member 170 and thus each of the fingers 148 is preferably made of a soft, pliable, compressible impact-absorbing and tacky material such as, for example, a thermoplastic elastomer such as Santoprene™.

Insert 170 has a generally frame or wing-like structure and is defined by upper and lower unitary and elongate spaced-apart rod-like frame or truss members 172 and 174. Upper frame member 172 is generally straight while the lower frame member 174 is generally arcuate and defines a center arched or curved back wall portion 176 corresponding in shape to the arc or curve defined by the shoulders 50 of the fingers 48 in the region of the back wall 28 of the head 20 and diametrically opposed side wall or wing portions 178 which curve outwardly and upwardly in the direction of the upper truss member 172 so as to correspond in shape to the curved ramp defined by the shoulders 50 of the fingers 48 in the respective side walls 30 and 32 of the head 20.

Fingers 148 extend unitarily in the up and down or vertical direction between, and in a generally vertical orientation and relationship generally transverse and opposite to, the upper and lower frame members 172 and 174. In the longitudinal or horizontal direction, the fingers 148 extend between the respective ends of the insert 170 in a generally spaced-apart and parallel relationship. The length of each of the fingers 148 defined in the insert 170 is determined and defined by the distance between the two frame members 172 and 174 thereof at the point where each of the fingers 148 is located in the horizontal or longitudinal direction. Each of the fingers 148 additionally define an outer surface 149 which slopes and protrudes outwardly and downwardly in the direction of the lower frame member 174 relative to the vertical plane of insert 170 in the same manner as outer surface 49 of fingers 48 (FIG. 8). Particularly, the slope is intended to increase progressively in the direction of the wing portions 178 from about five degrees for the fingers 148 in the region of the back wall portion 176 to about twenty degrees for the fingers 148 in the region of the wing portions 178. Each of the fingers 148 still further define a lower sloped and outwardly positioning shoulder 150, the slope being determined and defined by the slope of the curved lower frame member 174 at the point where the respective fingers 148 are joined to the lower frame member 174.

While the insert 170 has been described and shown herein as comprising a wing-like structure, it is understood that the invention encompasses all other insert embodiments adapted or configured to define or incorporate outwardly protruding fingers of the type shown in FIGS. 2–5.

Referring back to FIGS. 6 and 7, insert 170, being pliable and deformable, is adapted to be folded about the central back wall portion 176 thereof and inset into an elongate and expanded cavity or recess 180 formed, and extending into, the material comprising interior face 140 of the back wall 128 and respective side walls 130 and 132 of the frame 122. Recess 180 preferably corresponds in configuration and outline to the configuration and outline of the insert 170. Although not shown in any of the drawings, it is understood that an adhesive is intended to be applied either to the interior face 140 of the frame 122 or to the surface of the insert 170 to secure the insert 170 to the interior face 140 of the frame 122. The depth of the recess 180 is preferably equal to the thickness of the members 172 and 174 of the insert 170 so that the insert 170 may be disposed in a generally flush relationship with the interior face of the frame 122 with the fingers 148 protruding outwardly from the frame interior face 140 in the same manner as fingers 48 of the head 20 of FIGS. 25. Additionally, it is understood that the recess 180 may be sloped in the region of the back wall 128 so that the respective outer surfaces 149 of the respective fingers 148 in the region of the back wall 128 are positioned and disposed in a generally normal relationship relative to the longitudinal horizontal axis of the head 120. Still further, it is understood that the invention encompasses head embodiments wherein the frame is not recessed along the interior surface and the insert is simply adhered or otherwise suitably secured to the interior flat faces of the frame.

The configuration, placement, location, orientation, spacing and function of the fingers 148, following placement of the insert 170 in recess 180, is essentially the same as the configuration, placement, location, orientation, spacing and function of the fingers 48 in the head 20 and thus the description and discussion related thereto is incorporated herein by reference and applies to the fingers 148 as though fully set forth herein. Particularly, it is understood that, with the insert 170 positioned within the interior of frame 122, the fingers 148 protrude and project outwardly from the inner face 140 of the respective walls 128, 130 and 132 and vary in length between the back wall 128 and respective side walls 130 and 132 in the same manner as fingers 48 and further that the slope of the shoulders 150 of the respective fingers 148 which protrude outwardly from the inner face 40 varies between the back wall 128 and the respective side walls 130 and 132 in the same manner as the shoulders 50 and the slope of the surface 149 of the respective fingers 48 to provide the same advantages as those which are afforded by the fingers 48.

It is further understood that the fingers 148, being made of a compressible and impact-absorbing material, offer the added advantage of reducing rattle of the ball during its entry and receipt into the head. The "tacky" nature of the material comprising the insert 170 and each of the fingers 148 also offers the advantage of defining fingers adapted to grip and hold a ball in the head. For example, and as shown in FIGS. 8 and 9, the fingers 148 are configured to allow ball 154 to roll down the sloped outer surface 149 thereof into the center of the pocket 158 of the head 120. The tacky nature of the material comprising the insert 170 advantageously keeps the ball 154 against the surface 149 of the fingers 148 thus reducing the likelihood of the ball 154 falling out of the head 120. Moreover, it is understood that the spacing between each of the fingers 148 allows the ball 154 to be cradled between successive fingers as described earlier with respect to the fingers 48 of head 20. Thus, in situations where the ball 154 is located in a cradled relationship between successive fingers 148 as shown in FIG. 9 (such as, for example, where the ball 154 is being transferred between the pocket and the scoop), the fingers 148 are adapted to effectively grip or grasp the ball 154 therebetween, thus further reducing the risk of the ball 154 falling out of the head 120.

Figure 10:
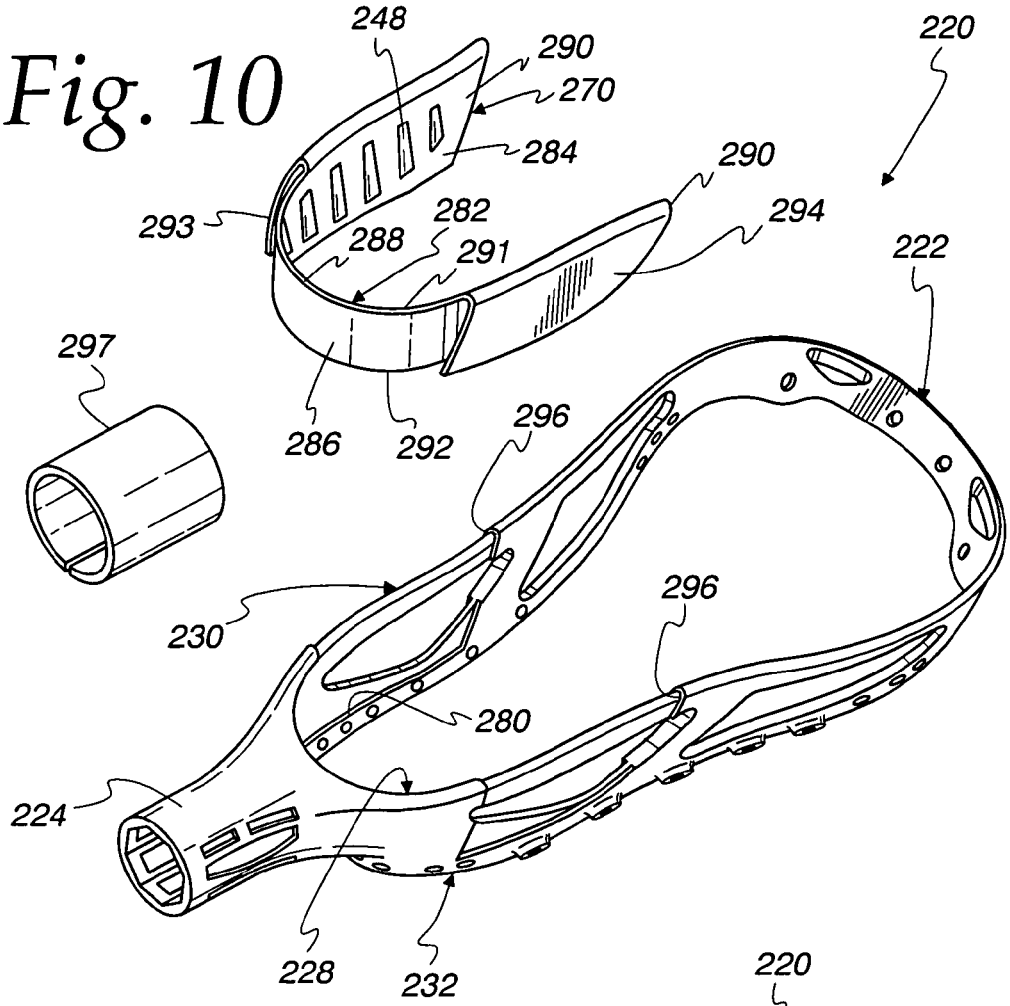
FIG. 10 is a top, exploded perspective view of another embodiment of the lacrosse stick head of the present invention wherein the fingers are unitary with a separate sleeved insert.
Figure 11:
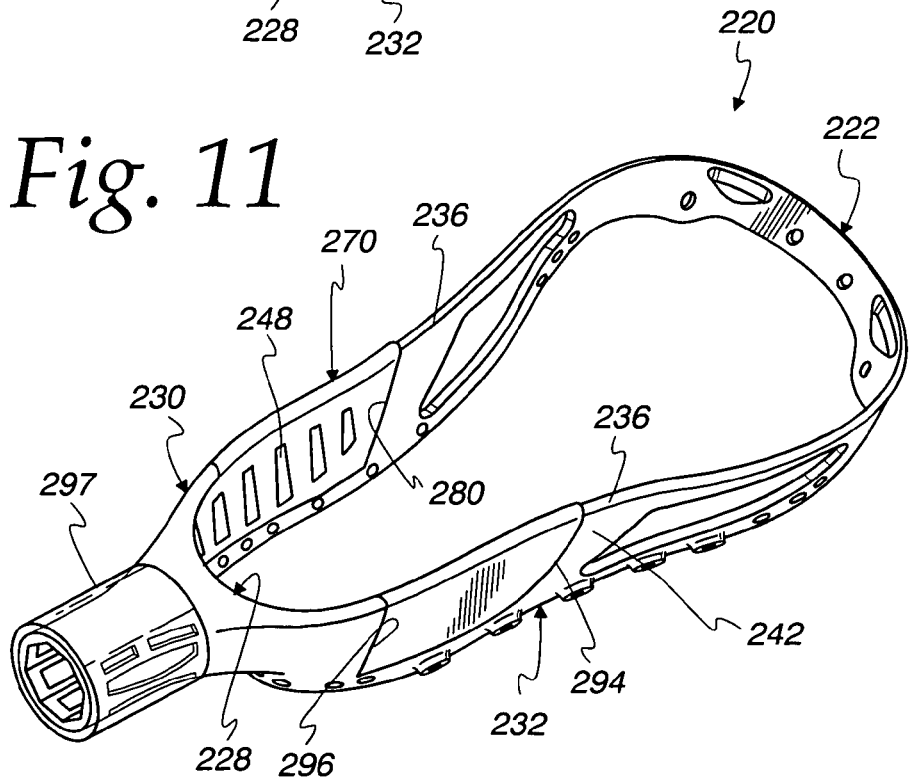
FIG. 11 is a top perspective view of the lacrosse stick head of FIG. 10 with the sleeved insert member adhesively secured to the frame of the head.

FIGS. 10 and 11 depict yet a further head embodiment 220 which is similar in structure to both the head embodiments 20 and 120 except that the head 220 is adapted to receive a pre-formed and molded sleeved insert 270 which is preferably made of the same type of soft, pliable, compressible, impact-absorbing, and tacky material as insert 170.

Insert 270 comprises a generally U-shaped elongate vertically oriented solid pliable and deformable sheet 282 defining interior and exterior vertical faces 284 and 286 respectively and a plurality of fingers 248 protruding and projecting unitarily outwardly from the interior face 284 of the sheet 282 and, more particularly, protruding outwardly from the back wall and side wall portions 288 and 290 thereof respectively. In accordance with the present invention, the fingers 248 extend in a generally vertical up and down direction between, and in an orientation and relationship generally transverse and opposite to, the top and bottom longitudinal edges 291 and 292 of the sheet 282. In the horizontal or longitudinal direction, fingers 248 extend along the length of the interior face 284 of the respective back wall and side wall portions 288 and 290 thereof in a spaced-apart and generally parallel relationship. Fingers 248 are shaped, sized, structured, configured, aligned and positioned on the interior face 284 of sheet 282 in a manner similar to that described earlier with respect to the fingers 48 and 148 to provide the same ball guidance, retention and transfer characteristics as the earlier finger embodiments when the insert 270 is positioned and set into the frame 222 into the relationship wherein the fingers 248 protrude outwardly from, and are spaced along, the back wall 228 and side walls 230 and 232 thereof. Thus, the discussion with respect to said earlier finger embodiments applies thereto and is incorporated herein by reference.

Insert 270 additionally comprises a pair of outer flaps or ears 293 and 294 which depend and hang unitarily downwardly from the top longitudinal edge 291 of the sheet 282 in the direction of the bottom longitudinal edge 292 of the sheet 282 and in a relationship spaced from the exterior face 286 of the respective side walls 290 thereof. Flaps 293 and 294 extend essentially the full length of the respective side wall portions 290.

Frame 222 of head 220 is similar in structure to the frame 122 of head 120 in that the interior face 240 of the back wall 228 and side walls 230 and 232 thereof defines an elongate recess or cavity 280 adapted to receive the sheet 282 of insert 270. However, and unlike the frame 122, frame 222 additionally defines recesses or cavities 296 defined and extending into the top longitudinal edge 236 and exterior face 242 of each of the respective side walls 230 and 232 which are adapted to receive the flaps 293 and 294 of insert 270 when insert 270 is set into the frame and the flaps 293 and 294 are wrapped around the top peripheral edge 236 and exterior face 242 of side walls 230 and 232 respectively as shown in FIG. 11.

As also shown in FIGS. 10 and 11, a cylindrically shaped pre-formed, molded hollow insert member 297 is adapted to surround the base 224.

Preferably, an adhesive is adapted to be applied alternatively either to the surface of the recesses 280 and 296 in the frame 222 or to the exterior faces 286 of the insert 270 for securing the insert 270 to the frame 222. An adhesive is likewise applicable to secure the base insert 297 around the periphery of base 224.

In accordance with the invention, sleeved insert 270 envelopes a portion of the respective frame side walls 230 and 232 and thus offers all of the advantages of the insert 170 while also offering the added advantage of providing a cushioned and compressible longitudinal top frame edge in the region of the side walls 230 and 232 which enhances the frame's ability to absorb the impact of the ball upon entry into the head and to grip the ball (by way of increased surface friction between the material comprising the insert and the ball) when the ball contacts the side wall edges.

Figure 12:
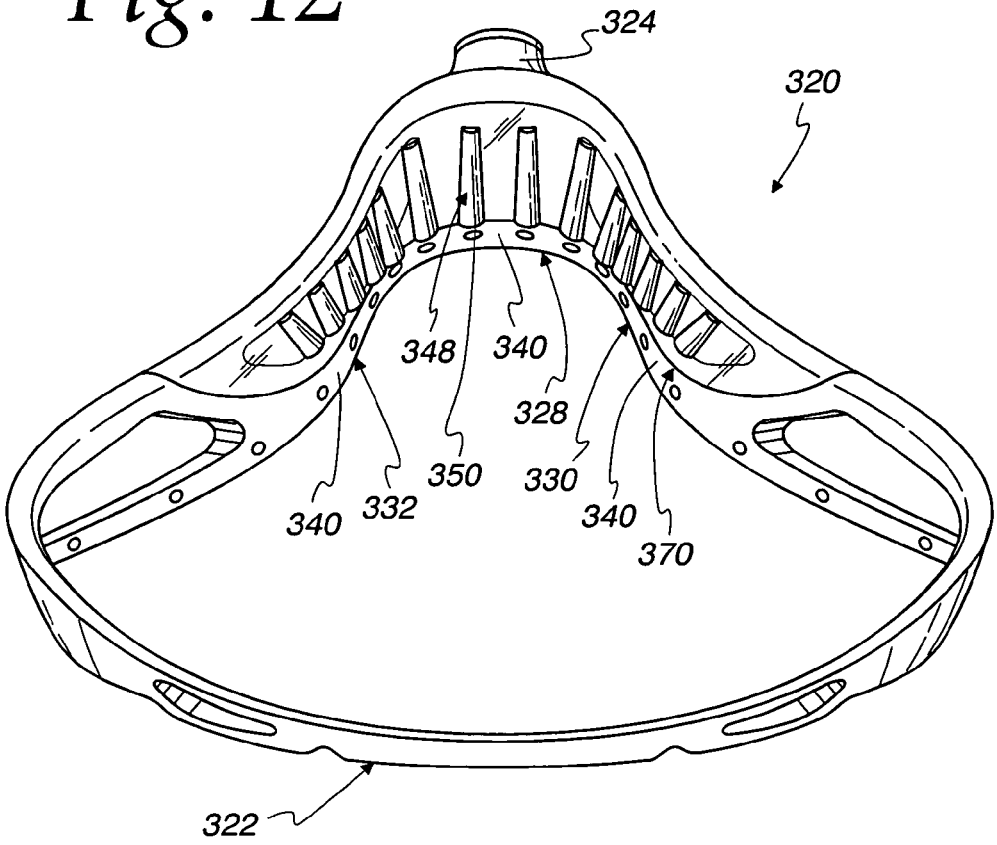
FIG. 12 is a top perspective view of yet a further embodiment of the lacrosse stick head of the present invention wherein the fingers are formed on an overmolded layer of material which surrounds a portion of the frame.
Figure 13:
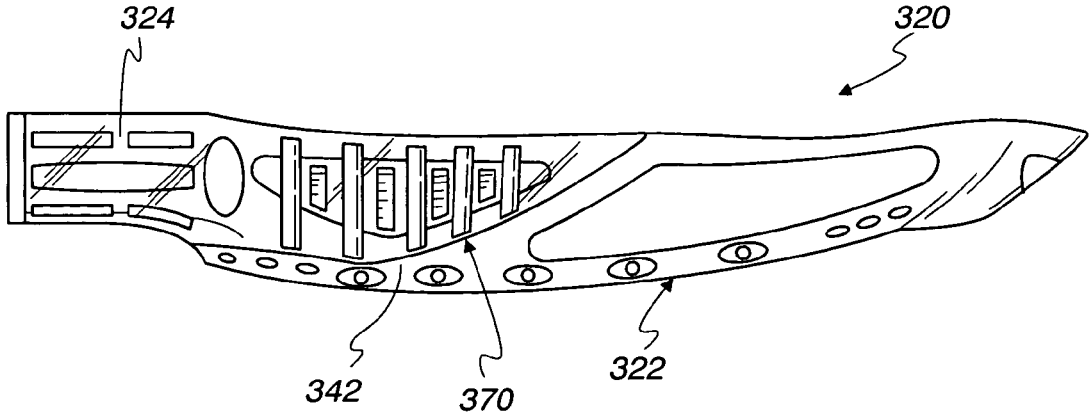
FIG. 13 is a side elevational view of the lacrosse head of FIG. 12.

FIGS. 12 and 13 depict a further head embodiment 320 wherein the fingers 348 and the respective shoulders 350 thereof protrude unitarily outwardly from the interior face of an overlay member 370 which is overmolded directly to the frame 322 of the head 320 during the manufacturing operation using any of the several molding or overlay processes known in the art including, for example, casting, interference fitting, spraying, injection molding, rotational molding, insert molding and over molding. As with the earlier head embodiments, the frame 322 is made of a first material while the overlay member 370 is made of a second material similar in composition to the second material comprising the earlier described pre-formed inserts.

Overlay member 370 is overmolded to the frame 322 in a manner wherein the overlay member 370 encircles and covers the handle base 324, the interior face 340 of the back wall 328 and selected portions of the interior and exterior faces 340 and 342 of the side walls 330 and 332 respectively. Fingers 348 protrude and project outwardly from the interior face 340 of the back wall 328 and side walls 330 and 332 and are shaped, configured, sized, spaced, structured and positioned along the interior face 340 of the back wall 328 and side walls 330 and 332 in a manner similar to the earlier described fingers 48, 148 and 248 to provide similar benefits and advantages and the description thereof in connection with the earlier embodiments applies thereto and is incorporated herein by reference. However, and unlike the earlier head embodiments, all the fingers 348 in the region of the back wall 328 have the same length and the shoulders 350 are not sloped.

Figure 14A:
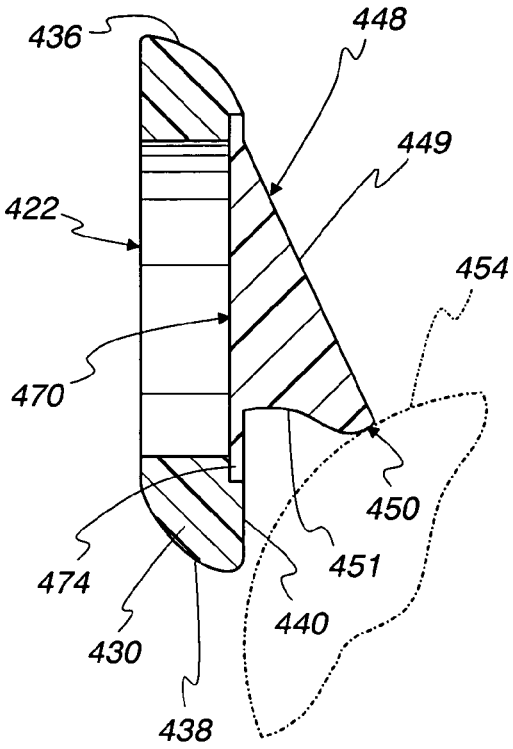
FIGS. 14A–C are enlarged vertical cross-sectional views of additional alternate configurations of the fingers of the lacrosse stick head of the present invention.
Figure 14B:
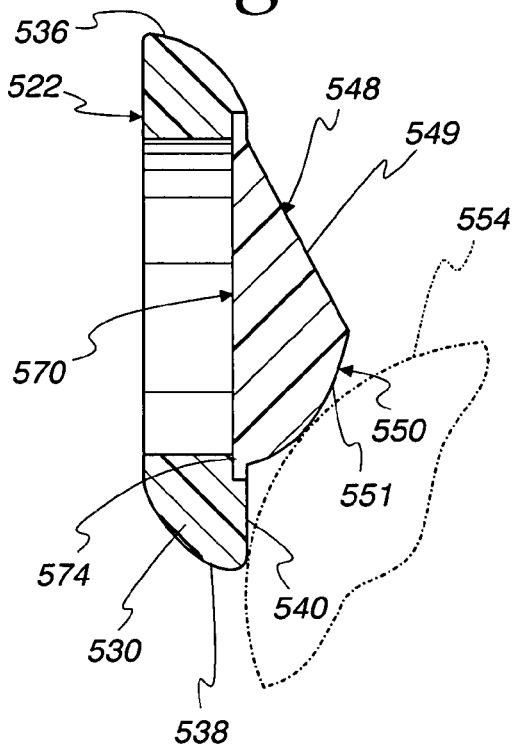
Figure 14C:
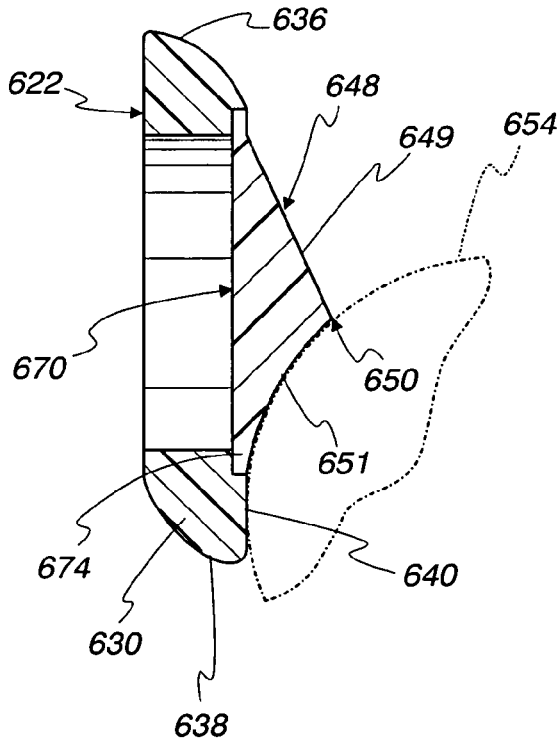

FIGS. 14A–C depict alternate insert embodiments 470, 570 and 670 incorporating alternate finger embodiments 448, 548, and 648 respectively.

Finger 448 depicted in FIG. 14A is similar in structure to the finger 148 in that it includes an outer ball guide wall 451 which slopes outwardly and downwardly from a point adjacent the top edge 436 to a point adjacent the bottom edge 438 of the side wall 430 in a generally up and down vertical direction generally transverse and opposite the direction of the top and bottom edges 436 and 438 respectively. The angle of inclination of wall 451 relative to the side wall 430 may vary in the same manner as the wall 49 of finger 48. A lower generally arcuate shoulder wall 449 extends generally normally outwardly between the lower truss 474 of the insert 470 and a distal lower end of the sloped outer guide wall 449 adjacent the bottom edge 438 to define a pointed shoulder 450 which protrudes outwardly from the inner face 440 of side wall 430 following the placement of insert 470 in the interior of the frame 222. In the configuration of FIG. 14A, finger 448 and, more particularly, the pointed shoulder 450 thereof, is adapted to surround and hold the ball 454 in a relationship wherein a portion of the top peripheral edge of the ball 454 is in abutting relationship with the tip of the shoulder 450 and a portion of the side peripheral surface of the ball 454 is positioned in abutting relationship with the inner face 440 of the respective frame walls to prevent the ball 454 from falling out of the head. The Santoprene™ material comprising the finger 448 advantageously allows the finger 448 to grip the ball 454.

The finger 548 shown in FIG. 14B is characterized in that it includes an outer ball guide wall 549 which slopes and protrudes downwardly and outwardly from the base of insert 570 in a generally up and down vertical orientation from a point adjacent the top edge 526 to a point adjacent the bottom edge 538. Finger 548 extends between, and in a directional relationship generally transverse and opposite to, the top and bottom edges 536 and 538 respectively. Wall 549 slopes and protrudes outwardly from the insert 570 at an angle relative to the side wall 530 similar to the angle of inclination of wall 49 of finger 48. Finger 548 additionally includes a lower generally convexly shaped shoulder wall 551 extending and protruding upwardly and outwardly between the lower truss 594 of the insert 570 and a distal lower end of the outer guide wall 549 to define a shoulder 550 which protrudes outwardly from the inner face 540 of side wall 530 following placement of the insert 570 within the interior of the frame 522 and defines an outer bumper for the ball 554. Particularly, the ball 554 is adapted to be positioned within the frame 522 in a relationship wherein the top peripheral edge of the ball 554 abuts against the shoulder 550 and the side peripheral surface of the ball 654 abuts against the inner face 540 of wall 530.

The finger 648 shown in FIG. 14C includes an outer ball guide wall 649 which protrudes and slopes downwardly and outwardly from the base of insert 670 in a generally up and down vertical orientation between, and in a generally transverse or opposed relationship to, the top and bottom edges 636 and 638 respectively of the side wall 630 and a generally concavely shaped lower outwardly protruding shoulder wall 651 extending outwardly and upwardly between the lower truss 674 of insert 670 and a lower distal end of the outer ball guide wall 649 to define an outwardly protruding shoulder 650 adapted to receive the top peripheral edge of the ball 654 and prevent the ball 654 from falling out of the head. Wall 649 extends from a point adjacent the top edge 636 to a point adjacent the bottom edge 638 and is inclined at an angle relative to side wall 630 similar to the angle of inclination of wall 49 of finger 48. Ball 654 is adapted to be received under shoulder 650 in a relationship wherein the side peripheral surface thereof is positioned in abutting relationship with both the surface of wall 651 of finger 648 and the inner surface 640 of frame side wall 630.

It will be readily apparent from the foregoing detailed description of the invention and from the illustrations thereof that numerous variations and modifications may be effected without departing from the true spirit and scope of the novel concepts or principles of this invention.

We claim:

1. A head of a lacrosse stick comprising:

a frame defining a pocket, the frame including upper and lower edges and an interior face therebetween;

a plurality of elongate ball guide fingers for guiding a ball in the pocket and directing the ball along a net, said fingers spaced along the interior face of the frame and having upper and lower ends;

the frame including a mounting for the net defining a ball-receiving portion; and the lower ends of the ball guide fingers, each including a substantially rounded outer surface protruding from the interior face so as to define a shoulder facing the ball-receiving portion.

2. The head of claim 1 wherein each of the fingers protrude unitarily outwardly from the interior face of the frame and include an outer surface which slopes outwardly as the fingers extend between the upper and lower edges of the frame.

3. The head of claim 1 wherein the frame includes a back stop wall and the fingers are spaced along the interior face of the frame in the region of the back stop wall.

4. The head of claim 1 wherein the frame includes a back stop wall and opposed side walls and the fingers are spaced along the interior frame between the back wall and the end of the respective side walls.

5. The head of claim 1 wherein the fingers are generally part frustoconical in shape.

6. The head of claim 1 wherein the fingers are made of rigid material.

7. The head of claim 1 wherein the plurality of fingers vary in length.

8. The head of claim 1 wherein the upper ends of the ball guide fingers are generally flush with the interior face.

9. The head of claim 8 wherein the lower ends of the plurality of fingers are spaced apart from one another along a curve corresponding generally in shape to the peripheral outer curve of a ball.

10. The head of claim 1 wherein the plurality of ball guide fingers have a thickness which varies along their length.

11. A head of a lacrosse stick comprising:

a frame defining a pocket at one end and a scoop at an opposite end;

the frame including upper and lower edges and an interior face therebetween;

the frame including a mounting for a net defining a ball-receiving portion;

the head further comprising a plurality of outwardly protruding fingers spaced along the interior face of the frame and extending between the upper and lower edges of the frame in a generally opposed directional relationship thereto; and each of the fingers having a substantially rounded, outer sloped surface for directing a lacrosse ball into the pocket and a lower shoulder facing the ball-receiving portion for guiding the ball in the pocket and directing the ball along the net, between the pocket and the scoop.

12. The head of claim 11 wherein the fingers protrude unitarily outwardly from the interior face of the frame.

13. The head of claim 11 wherein the length of the fingers vary along the interior face of the frame.

14. The head of claim 11 wherein the frame includes a back wall at one end, a scoop wall at the other end and a pair of side walls therebetween, the fingers extending along the back wall and side walls respectively and the length of the fingers increasing progressively between the back wall and respective side walls and then decreasing progressively along each of the respective side walls in the direction of the scoop wall.

15. The head of claim 11 wherein the shoulder on each of the fingers is sloped and the slope of the shoulders of successive fingers decreases progressively between the back wall and the respective side walls and then increases progressively along the respective side walls in the direction of the scoop wall.

16. The head of claim 11 wherein the fingers are generally part frustoconical in shape.

17. The head of claim 11 wherein the fingers are made of rigid material.

18. The head of claim 11 wherein the plurality of fingers vary in length.

19. The head of claim 11 wherein the fingers have upper and lower ends, the upper ends being generally flush with the interior face and the lower ends protruding from the interior face.

20. The head of claim 19 wherein the lower ends of the plurality of fingers are spaced apart from one another along a curve corresponding generally in shape to the peripheral outer curve of a ball.

21. The head of claim 11 wherein the plurality of ball guide fingers have a thickness which varies along their length.

22. A head of a lacrosse stick comprising:

a frame defining a pocket, the frame including a back wall disposed between a pair of sidewalls, each having upper and lower edges and an interior face therebetween;

the frame including a mounting below the lower edges of the back wall and the sidewalls for a net that defines a ball-receiving portion;

a plurality of elongate ball guide fingers spaced along the interior face of the back wall and the sidewalls, between the upper and the lower edges of the back wall and the sidewalls and extending toward the net; and the fingers having outer surfaces facing away from the interior face and defining progressively increasing angles with respect to the interior face, wherein said fingers are for guiding a ball in the pocket and directing the ball along the net.

23. The head of claim 22 wherein the angle of the fingers increase from a minimum at the back wall to a maximum at the sidewalls.

24. The head of claim 22 wherein the outer surfaces of the fingers are generally part conical in shape.

25. The head of claim 24 wherein the transverse cross sectional areas of the fingers increase from the top edge to the bottom edge.

26. A head of a lacrosse stick comprising:

a frame defining a pocket, the frame including a back wall disposed between a pair of sidewalls, each having upper and lower edges and an interior face therebetween;

the frame including a mounting below the lower edges of the back wall and the sidewalls for a net that defines a ball-receiving portion;

a plurality of elongate ball guide fingers spaced along the interior face of the back wall and the sidewalls, between the upper and the lower edges of the back wall and the sidewalls and extending toward the net; and the fingers having outer surfaces facing away from the interior face and end surfaces extending generally perpendicular to the outer surfaces, facing the net, wherein said fingers are for guiding a ball in the pocket and directing the ball along the net.

27. The head of claim 26 wherein the end surfaces have a generally semicircular shape.

28. The head of claim 26 wherein the end surfaces lie along a curve corresponding generally in shape to the outer curve of a lacrosse ball.

29. A head of a lacrosse stick comprising:

a frame defining a pocket, the frame including a back wall disposed between a pair of sidewalls, each having upper and lower edges and an interior face therebetween;

the frame including a mounting below the lower edges of the back wall and the sidewalls for a net defining a ball-receiving portion;

a plurality of elongate ball guide fingers spaced along the interior face of the back wall and the sidewalls, between the upper and the lower edges of the back wall and the sidewalls and extending toward the net; and the fingers having longitudinal lengths which vary from one finger to another, wherein said fingers are for guiding a ball in the pocket and directing the ball along the net.

30. The head of claim 29 wherein the sidewalls define openings and the fingers extend across the openings.

* * * * *